United States Patent [19]

Zijsling

[11] Patent Number: 4,830,124

[45] Date of Patent: May 16, 1989

[54] ROTARY DRILL BIT

[75] Inventor: Djurre H. Zijsling, AB Rijswijk, Netherlands

[73] Assignee: Shell Oil Company, Houston, Tex.

[21] Appl. No.: 896,682

[22] Filed: Aug. 15, 1986

[30] Foreign Application Priority Data

Jan. 21, 1986 [GB] United Kingdom ..... 8601360

[51] Int. Cl.[4] ..... E21B 10/60

[52] U.S. Cl. ..... 175/393; 175/424

[58] Field of Search ..... 175/393, 422 R, 329, 175/339, 340; 299/81

[56] References Cited

U.S. PATENT DOCUMENTS 2,365,941 12/1944 Crake ..... 175/393
4,116,289 9/1978 Feenstra ..... 175/329
4,452,324 6/1984 Jürgens ..... 175/393
4,529,250 7/1985 Radford et al. ..... 175/393 X

FOREIGN PATENT DOCUMENTS 0151548 8/1985 European Pat. Off. ..... 175/393
0169110 1/1986 European Pat. Off. ..... 175/393
1265943 5/1961 France ..... 175/393

*Primary Examiner*—Stephen J. Novosad
*Assistant Examiner*—David J. Bagnell

[57] ABSTRACT

A drag type bit is equipped with nozzles for creating high velocity mud jets discharging into waterways in front of the wings of the bit, which nozzles are oriented such that each jet successively strikes the borehole bottom and front face of a wing at a small angle.

6 Claims, 2 Drawing Sheets

ROTARY DRILL BIT

BACKGROUND OF THE INVENTION

The invention relates to a rotary drill bit and more particularly it relates to a drag type rotary drill bit equipped with cutting elements positioned on wings.

Conventional drag type drill bits are commonly provided with nozzles which discharge into waterways in front of the wings and which direct high velocity mud jets in a direction orthogonal to the borehole bottom. A disadvantage of this known arrangement is that in some formations drill cuttings are removed to an insufficient extent from the region of the cutting elements, thereby causing overheating of the elements and reduced drilling progress.

Numerous attempts have been made to improve the cleaning and cooling performance of mud jets. U.S. Pat. No. 2,365,941 discloses a bit provided with nozzles which direct the high velocity mud jets in a substantially parallel direction relative to the cutting elements of the bit and to the borehole wall. U.S. Pat. No. 4,116,289 discloses a bit provided with nozzles which direct the mud jets towards the front face of the cutting elements of the bit in such a manner that the jets strike said front faces at an acute angle.

Although the known arrangements generally enhance the cleaning and cooling performance provided by the mud jets, it was found that removal of drill cuttings sometimes stagnated, particularly in shaly formations.

SUMMARY OF THE INVENTION

An object of the invention is to provide a rotary drill bit in which the nozzles are arranged such that both bottom hole cleaning and bit cooling and cleaning are further optimized.

In a drill bit according to the invention, the nozzles for creating high velocity mud jets are oriented in such a manner that during drilling each jet strikes both the borehole bottom and front face of a wing at a small angle.

In general, it is preferred that the first impact of the jets occurs at the hole bottom from which the jet is subsequently splashed back towards the front face of a wing. However, if formations have to be drilled where bit cleaning has first priority, the nozzle positions and orientations can be designed such that the first impact of the jets occurs at the front face of the wings rather than at the hole bottom.

BRIEF DESCRIPTION OF THE DRAWINGS

The invention will now be explained in more detail by way of example with reference to the accompanying drawings, in which.

DETAILED DESCRIPTION OF THE PREFERRED EMBODIMENT

Figure 1:
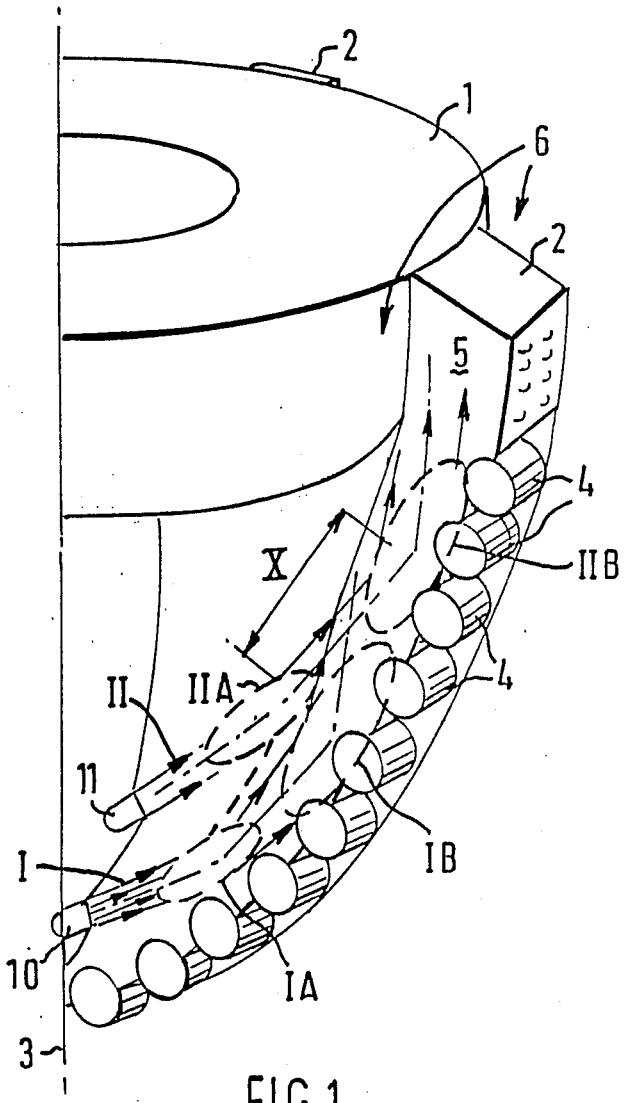
FIG. 1 shows a sketch of part of a parabolically shaped bit with two nozzles positioned and oriented according to the invention.

In FIG. 1 there is shown a drag bit with a parabolically shaped bit body, on which a plurality of wings 2 are mounted. The wings 2 extend in a substantially radial direction relative to an axis of symmetry 3 of the bit and each wing 2 carries a plurality of polycristalline diamond compact (PDC) cutting elements 4 in such a manner that the frontal surfaces of the elements 4 are flush to a front face 5 of each wing 2.

Between each pair of adjacent wings 3, a waterway 6 is formed for passing drilling mud alongside the borehole bottom or hole bottom 12 (not shown in FIG. 1) and the cutting elements 4, thereby cooling the cutting elements and removing drill cuttings from the borehole bottom. The bit is provided with a plurality of nozzles for creating high velocity mud jets discharging into the waterways 6.

Figure 2:
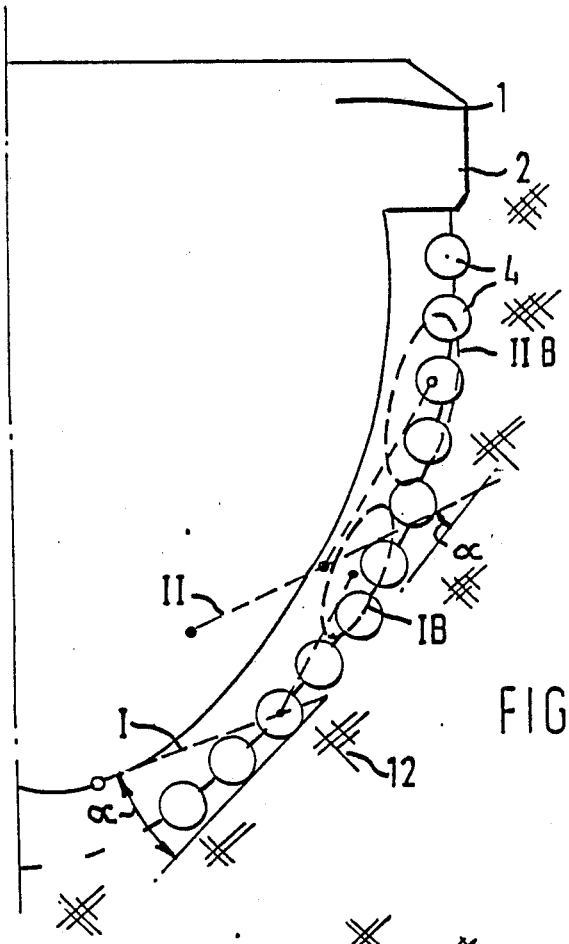
FIG. 2 represents a front view of a wing of the bit shown in FIG. 1.
Figure 3:
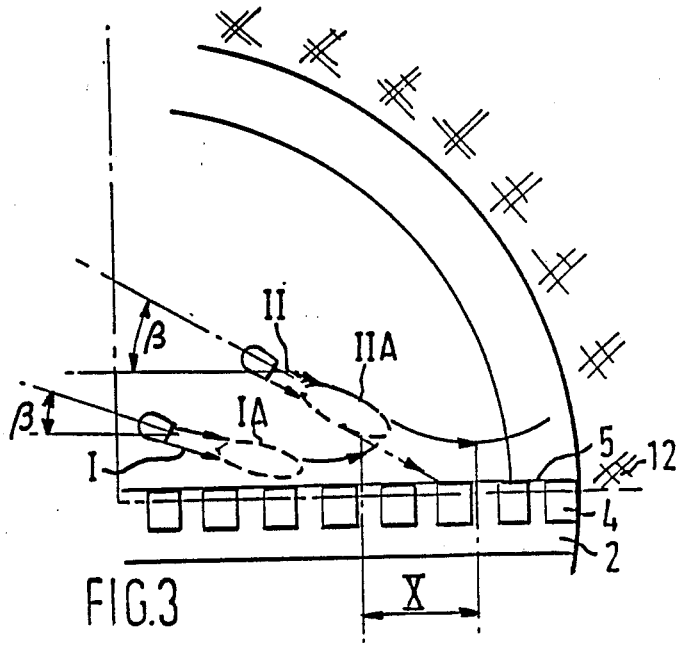
FIG. 3 represents a bottom view of the bit shown in FIG. 1.

In the drawing two adjacent nozzles 10, 11 are shown, which nozzles are as illustrated in FIGS. 2 and 3, oriented at an acute angle $\alpha$ relative to the borehole bottom 12 and simultaneously at an acute angle $\beta$ relative to the front surface 5 of wing 2. Said angles $\alpha$ and $\beta$ are preferably chosen between 15 degrees and 45 degrees.

In the example shown, the distance between the nozzles 10, 11 and the front surface 5 of the wing 2 is slected such that the high velocity jets I and II of the nozzles 10 and 11, respectively, reach the hole bottom 12 first and are subsequently splashed back toward the front face 5 of the wing 2.

As can be seen in FIGS. 1 and 3 the path of each jet I, II is such that the jet strikes the borehole within an elliptical impact area IA, IIA, respectively, from which the jet is splashed back and diverged towards the front face 5 of the wing 2. Each jet I, II subsequently strikes the front face 5 within another elliptical impact area IB, IIB, respectively, from which it is again splashed back. After this second impact the path of each jet will diverge again and the orientation of the nozzles 10, 11 is selected such that the jet I splashing back from the impact area IB on the wing 2 interferes with the jet II splashing back from impact area IIA on the hole bottom 12 within an area of interference X.

This interference results in a concentration of the jet I from nozzle 10 in front of the wing 2, thereby creating over a long distance an artificial high velocity jet stream along the front face of the wing and causing the majority of the hydraulic energy of the jet I to be dissipated in front of the wing 2.

The high velocity jet stream thereby removes drill cuttings from said face 5 and effectively cools the cutting elements 4.

It wil be understood that the interference of adjacent mud jets can also be extended to more than two nozzles.

In the case that the bit is provided with more than two nozzles, it is preferred to distribute the various nozzles along the face of the bit in such a manner that the various surfaces of revolution described by the various areas of impact on the hole bottom overlap each other such that the entire hole bottom is scavenged by the high velocity jets during each rotation of the bit.

If formations have to be drilled where bit cleaning has first priority, the nozzle positions and orientations can be designed such that the first impact of the jets occurs at the front face of the wings rather than at the hole bottom. In that case less energy is left for bottom cleaning.

Many other variations and modifications may be made in the apparatus and techniques described above without departing from the concept of the present invention. Accordingly, it should be clearly understood that the apparatus and methods depicted in the accompanying drawings and referred to in the foregoing description are illustrative only and are not intended as limitations on the scope of the invention.

What is claimed is:

1. A drag type drill bit for use at a bore-hole bottom, comprising:

wings having a front face and defining waterways adjacent the front face;

cutting elements positioned on the wings; and paired nozzles for creating high velocity mud jets discharging into the waterways in front of the wings, said paired nozzles being oriented in such a manner that during drilling each jet strikes both the borehole bottom and front face of a wing at a small angle, with one of the jets directed to deflect into the path of the other jet at a small angle.

2. The bit of claim 1 wherein the paired nozzles are oriented such that the first impact of the jets occurs at the borehole bottom adjacent the front face of the wings.

3. The bit of claim 2 wherein the paired nozzles are oriented such that the path of each jet is such that the jet first strikes the borehole bottom within an elliptical impact area from which the jet is splashed back and diverged towards the front face of one of the wings thereby striking said front face of the wing within another elliptical impact area from which one of the jets is splashed back in such a manner that it subsequently interferes with the path of the other jet.

4. The bit of claim 3 wherein the paired nozzles are distributed in such a manner that during each rotation of the bit the entire borehole bottom is scavenged by the jets.

5. The bit of claim 1 wherein the paired nozzles are oriented such that the first impact of each of the jets occurs at the front face of the wings.

6. The bit of claim 5 wherein the paired nozzles are oriented such that the path of each jet is such that the jet first strikes the front face of one of the wings within an elliptical impact area from which the jet is splashed back and diverged towards the borehole bottom thereby striking the borehole bottom within another elliptical impact area from which one of the jets is splashed back in such a manner that it subsequently interferes with the path of the other jet.

* * * * *